US011114226B2

(12) United States Patent
Jayaraman et al.

(10) Patent No.: US 11,114,226 B2
(45) Date of Patent: Sep. 7, 2021

(54) ULTRA-LOW COBALT IRON-COBALT MAGNETIC ALLOYS

(71) Applicant: Carpenter Technology Corporation, Reading, PA (US)

(72) Inventors: Tanjore V. Jayaraman, Wyomissing, PA (US); Chins Chinnasamy, Reading, PA (US); Samuel Kernion, Reading, PA (US); Eric Fitterling, Reading, PA (US)

(73) Assignee: CARPENTER TECHNOLOGY CORPORATION, Reading, PA (US)

( * ) Notice: Subject to any disclaimer, the term of this patent is extended or adjusted under 35 U.S.C. 154(b) by 0 days.

(21) Appl. No.: 16/559,996

(22) Filed: Sep. 4, 2019

(65) Prior Publication Data

US 2020/0005975 A1 Jan. 2, 2020

Related U.S. Application Data

(63) Continuation-in-part of application No. 14/702,933, filed on May 4, 2015, now abandoned.

(51) Int. Cl.
*H01F 1/147* (2006.01)
*C22C 38/30* (2006.01)
(Continued)

(52) U.S. Cl.
CPC ..... *H01F 1/147* (2013.01); *C22C 33/04* (2013.01); *C22C 38/004* (2013.01); *C22C 38/02* (2013.01);
(Continued)

(58) Field of Classification Search
CPC ..... C22C 38/02; C22C 38/04; C22C 38/30; C22C 38/34; C22C 38/52; H01F 1/147
See application file for complete search history.

(56) References Cited

U.S. PATENT DOCUMENTS 3,843,424 A 10/1974 Thornburg et al.
3,868,278 A 2/1975 Foster et al.
(Continued)

FOREIGN PATENT DOCUMENTS

CN 1468438 1/2004
DE 102008053310 4/2010
(Continued)

OTHER PUBLICATIONS

English Translation of Taiwanese Office Action dated Jul. 19, 2019 for Taiwan Patent Application No. 105113316.
(Continued)

*Primary Examiner* — Nicholas A Wang
(74) *Attorney, Agent, or Firm* — Stradley Ronon Stevens & Young, LLP

(57) ABSTRACT

A magnetic iron alloy and process of making the same. The alloy includes iron, approximately 2 wt. % to approximately 8 wt. % cobalt, approximately 0.05 wt. % to approximately 5 wt. % manganese, and approximately 0.05 wt. % to approximately 5 wt. % silicon. The alloy may also include up to approximately 0.3 wt. % chromium, up to approximately 2 wt. % vanadium, up to approximately 1 wt. % nickel, up to approximately 0.05 wt. % niobium, and up to approximately 0.02 wt. % carbon.

14 Claims, 9 Drawing Sheets

(51) Int. Cl.

| | |
|---|---|
| ***C22C 38/38*** | (2006.01) |
| ***C22C 33/04*** | (2006.01) |
| ***C22C 38/00*** | (2006.01) |
| ***C22C 38/02*** | (2006.01) |
| ***C22C 38/04*** | (2006.01) |
| ***C22C 38/34*** | (2006.01) |
| ***C22C 38/44*** | (2006.01) |
| ***C22C 38/52*** | (2006.01) |
| ***C22C 38/58*** | (2006.01) |

(52) U.S. Cl.
CPC ..... *C22C 38/04* (2013.01); *C22C 38/30* (2013.01); *C22C 38/34* (2013.01); *C22C 38/38* (2013.01); *C22C 38/44* (2013.01); *C22C 38/52* (2013.01); *C22C 38/58* (2013.01)

(56) References Cited

U.S. PATENT DOCUMENTS

| | | | | |
|---|---|---|---|---|
| 7,909,945 | B2 | 3/2011 | Pieper et al. | |
| 2002/0062885 | A1 | 5/2002 | Li | |
| 2009/0184790 | A1 | 7/2009 | Pieper et al. | |
| 2010/0097171 | A1* | 4/2010 | Urata ..... | C21D 8/1211 336/233 |

FOREIGN PATENT DOCUMENTS

| | | | |
|---|---|---|---|
| FR | 2173187 | | 10/1973 |
| JP | 2000129410 | * | 5/2000 |
| JP | 2011-84761 | | 4/2011 |
| JP | 2011084761 | * | 4/2011 |
| WO | 1996/019001 | | 6/1996 |
| WO | 1998/052200 | | 11/1998 |
| WO | 2002/031844 | | 4/2002 |
| WO | 02/079534 | | 10/2002 |

OTHER PUBLICATIONS

European Search Report dated Sep. 30, 2016, for corresponding European patent application No. EP 16167502.

* cited by examiner

ULTRA-LOW COBALT IRON-COBALT MAGNETIC ALLOYS

RELATED APPLICATION

This application is a continuation-in-part of U.S. patent application Ser. No. 14/702,933 filed on May 4, 2015. This application incorporates by reference into this document all prior applications in their entirety and for all purposes.

TECHNICAL FIELD

The invention relates generally to soft magnetic alloys, and particularly to iron-cobalt alloys containing less than or equal to 10 wt. % cobalt.

BACKGROUND

Iron-cobalt alloys are known in the industry to provide a high degree of magnetic saturation. In particular, 49Co—Fe-2V (HIPERCO® 50 alloy available from Carpenter Technology Corporation) is a commercially available alloy that provides the highest magnetic saturation induction and 27Co—Fe (HIPERCO® 27 alloy, also available from Carpenter) is known to provide a high degree of magnetic saturation coupled with relatively high ductility and toughness. Each of these alloys contains a large amount of cobalt (approximately 50% for HIPERCO® 50, and 27% for HIPERCO® 27). Cobalt is an expensive metal and greatly increases costs. In airborne applications, the cost of these alloys is justified by their superior room-temperature and high-temperature magnetic and electrical properties combined with adequate mechanical properties. For land and marine applications, however, there is a need for a less-expensive soft magnetic alloy that retains the superior magnetic and electrical properties coupled with suitable mechanical properties and corrosion resistance. Exemplary land and marine applications include fly wheels, mechanical bearings, solenoids, reluctance motors, generators, fuel injectors, and transformers. There is further a need for a soft magnetic alloy with a greater electrical resistivity so that the alloy is suitable for both alternating current and direct current applications.

SUMMARY

To meet these and other needs, and in view of its purposes, the present invention provides ultra-low cobalt iron-cobalt magnetic alloys. One exemplary embodiment of the invention includes a magnetic iron alloy having iron, approximately 2 wt. % to approximately 10 wt. % cobalt, approximately 0.05 wt. % to approximately 5 wt. % manganese, and approximately 0.05 wt. % to approximately 5 wt. % silicon. The alloy may further have one or more of chromium up to approximately 3 wt. %, vanadium up to approximately 2 wt. %, nickel up to approximately 1 wt. %, niobium up to approximately 0.05 wt. %, and carbon up to approximately 0.02 wt. %. The alloy may have an electrical resistivity (ρ) of at least approximately 40 μΩcm. The alloy may have a saturation induction ($B_s$) of at least approximately 20 kG. The alloy may have a coercivity ($H_c$) of less than approximately 2 Oe. The alloy may include primarily a single alpha phase.

Another exemplary embodiment includes a magnetic iron alloy having iron, approximately 2 wt. % to approximately 10 wt. % cobalt, approximately 0.05 wt. % to approximately 5 wt. % manganese, and approximately 0.05 wt. % to approximately 5 wt. % silicon; and having a p of at least approximately 40 μΩcm, a $B_s$ of at least approximately 20 kG, and a $H_c$ of less than approximately 2 Oe. The alloy may further have one or more of chromium up to approximately 3 wt. %, vanadium up to approximately 2 wt. %, nickel up to approximately 1 wt. %, niobium up to approximately 0.05 wt. %, and carbon up to approximately 0.02 wt. %. The alloy may include primarily a single alpha phase.

BRIEF DESCRIPTION OF DRAWINGS

The invention is best understood from the following detailed description when read in conjunction with the accompanying drawing. It is emphasized that, according to common practice, the various features of the drawing are not to scale. On the contrary, the various features are arbitrarily expanded or reduced for clarity. Included in the drawing are the following figures.

DETAILED DESCRIPTION

Figure 1A:
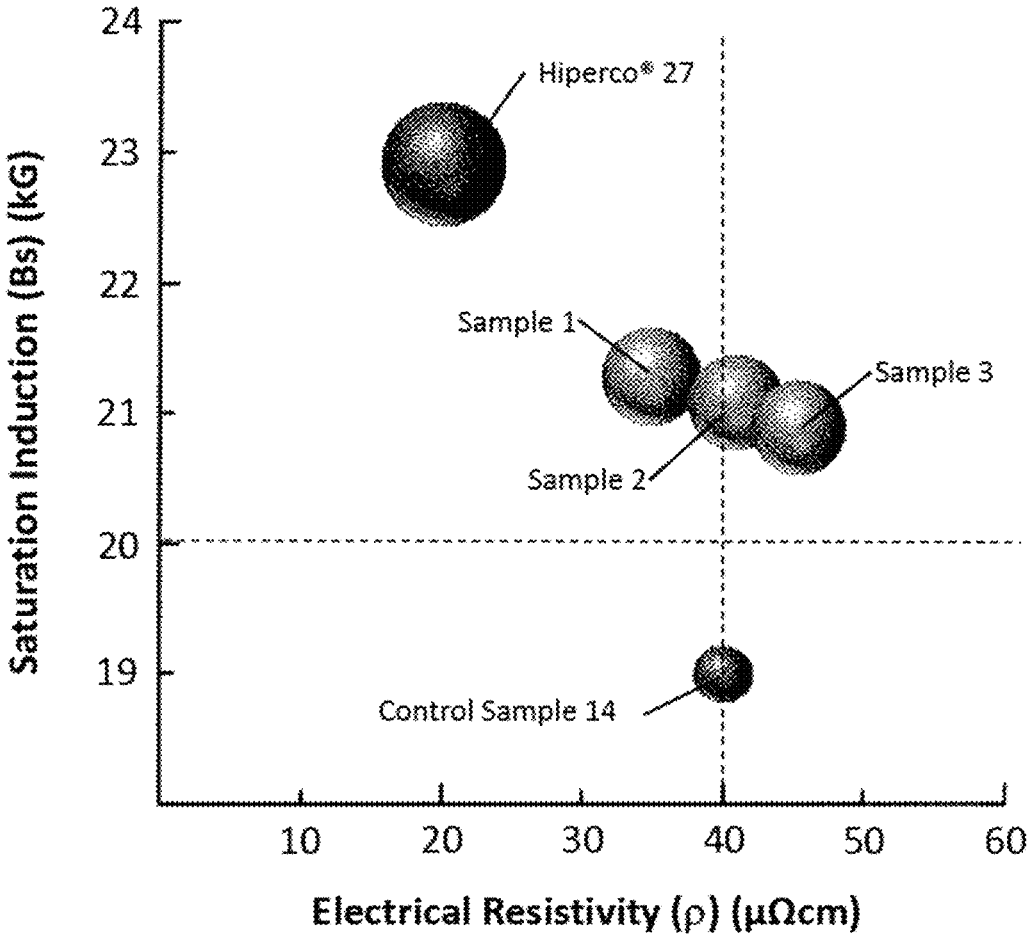
FIG. 1A is a graph depicting saturation induction ($B_s$), coercivity ($H_c$), and electrical resistivity (ρ) for a series of alloys having approximately 10 wt. % Cobalt (Co) as compared to HIPERCO® 27 and a substantially Co-free control sample, according to an embodiment of the invention.

Embodiments of the invention provide for magnetic iron alloys including cobalt and manganese possessing high magnetic saturation induction, high resistivity, low coercivity, as well as relatively good mechanical properties including ductility and toughness. The alloy may be used in marine and land applications requiring a combination of good mechanical toughness, good ductility, high saturation induction, and high electrical resistivity, such as motors, generators, rotors, stators, pole pieces, relays, magnetic bearings, and the like. The high electrical resistivity of the alloys will further allow the alloys to be used in alternating current applications as higher electrical resistivity reduces eddy-current loss. Embodiments include both the alloys as well as the process of producing the alloys.

As used in this document, an "alloy" refers to a homogeneous mixture or solid solution of two or more metals, the atoms of one metal replacing or occupying interstitial and/or substitutional positions between the atoms of the other metals. The term alloy can refer to both a complete solid solution alloy that can give a single solid phase microstructure and a partial solution that can give two or more phases.

As used in this document and in the claims, the terms "comprising," "having," and "including" are inclusive or open-ended and do not exclude additional unrecited elements, compositional components, or steps. Accordingly, the terms "comprising," "having," and "including" encompass the more restrictive terms "consisting essentially of" and "consisting of." Unless specified otherwise, all values provided in this document include up to and including the endpoints given, and the values of the constituents or components of the compositions are expressed in weight percent or % by weight of each ingredient in the composition.

Magnetic Iron Alloys Including Cobalt, Manganese, and Silicon

Embodiments of the invention include magnetic iron alloys having cobalt, silicon, and manganese. For example, the magnetic iron alloy may include approximately 2 wt. % to approximately 10 wt. % cobalt (Co), approximately 0.05 wt. % to approximately 5 wt. % manganese (Mn), and approximately 0.05 wt. % to approximately 5% silicon (Si). Co improves the magnetic saturation induction of the alloy, but decreases certain mechanical properties and is relatively expensive. Mn and Si are relatively inexpensive elements and scrap from processing the alloy can be used as recyclable material for many grades to reduce cost. Alloys according to embodiments of the invention contain much less Co than known alloys such as HIPERCO® 50 and HIPERCO® 27 while still maintaining suitable magnetic, electrical, and mechanical properties.

The magnetic iron alloy may preferably include approximately 2 wt. % to approximately 8 wt. % Co, approximately 2 wt. % to approximately 5 wt. % Co, approximately 5 wt. % to approximately 10 wt. % Co, approximately 5 wt. % to approximately 8 wt. % Co, or approximately 8 wt. % to approximately 10 wt. % Co. The magnetic iron alloy may more preferably include approximately 5 wt. % Co, approximately 8 wt. % Co, or approximately 10 wt. % Co.

The magnetic iron alloy may preferably include approximately 0.05 wt. % to approximately 2.70 wt. % Mn, approximately 0.05 wt. % to approximately 2.20 wt. % Mn, approximately 0.05 wt. % to approximately 1 wt. % Mn, approximately 1 wt. % to approximately 5 wt. % Mn, approximately 1 wt. % to approximately 2.70 wt. % Mn, approximately 1 wt. % to approximately 2.20 wt. % Mn, approximately 2.20 wt. % to approximately 5 wt. % Mn, approximately 2.20 wt. % to approximately 2.70 wt. % Mn, or approximately 2.70 wt. % to approximately 5 wt. % Mn. The magnetic iron alloy may more preferably include approximately 1.0 wt. % Mn, approximately 2.2 wt. % Mn, or approximately 2.7 wt. % Mn.

The magnetic iron alloy may preferably include approximately 0.05 wt. % to approximately 2.3 wt. % Si, approximately 0.05 wt. % to approximately 1.3 wt. % Si, approximately 1.3 wt. % to approximately 5 wt. % Si, approximately 1.3 wt. % to approximately 2.3 wt. % Si, or approximately 2.3 wt. % to approximately 5 wt. % Si. The magnetic iron alloy may more preferably include approximately 1.3 wt. % Si or approximately 2.3 wt. % Si.

A preferred magnetic iron alloy according to embodiments of the invention includes approximately 10 wt. % Co, approximately 2.7 wt. % Mn, and approximately 1.3 wt. % Si. Another preferred magnetic iron alloy according to embodiments of the invention includes approximately 8 wt. % Co. approximately 2.2 wt. % Mn, and approximately 1.3 wt. % Si. Another preferred magnetic iron alloy according to embodiments of the invention includes approximately 5 wt. % Co, approximately 2.2 wt. % Mn, and approximately 1.3 wt. % Si. Another preferred magnetic iron alloy according to embodiments of the invention includes approximately 5 wt. % Co, approximately 1.0 wt. % Mn, and approximately 2.3 wt. % Si.

The magnetic iron alloy may include amounts of other suitable alloying elements such as chromium, vanadium, nickel, niobium, and carbon. In another exemplary embodiment, the magnetic iron alloy may include up to approximately 3 wt. % chromium, up to approximately 2 wt. % vanadium, up to approximately 1 wt. % nickel, up to approximately 0.05 wt. % niobium, and up to approximately 0.02 wt. % carbon. In each of the embodiments described above, the balance of the alloy (i.e., the percentage of the alloy not made up of Co, Mn, Si, or other suitable alloying elements) is iron (Fe).

The magnetic iron alloy may include amounts of other suitable alloying elements such as sulfur (S), copper (Cu), titanium (Ti), molybdenum (Mo), phosphorus (P), aluminum (Al), zirconium (Zr), gadolinium (Gd), cerium (Ce), calcium (Ca), and combinations thereof.

In certain embodiments the magnetic iron alloy includes sulfur in amounts: up to about 0.015 wt %, up to about 0.014 wt %, up to about 0.013 wt %, up to about 0.012 wt %, and up to about 0.011 wt %, 0.01 wt %, up to about 0.009 wt %, up to about 0.008 wt %, up to about 0.007 wt %, and up to about 0.006 wt %, 0.005 wt %, up to about 0.004 wt %, up to about 0.003 wt %, up to about 0.002 wt %, and up to about 0.001 wt %. The magnetic alloy may also include sulfur in the range of: from 0.001 wt % to about 0.015 wt %, from 0.001 wt % to about 0.014 wt %, from 0.001 wt % to about 0.013 wt %, from 0.001 wt % to about 0.012 wt %, from 0.001 wt % to about 0.011 wt %, from 0.001 wt % to about 0.01 wt %, from 0.001 wt % to about 0.009 wt %, from 0.001 wt % to about 0.008 wt %, from 0.001 wt % to about 0.007 wt %, from 0.001 wt % to about 0.006 wt %, from 0.001 wt % to about 0.005 wt %, from 0.001 wt % to about 0.004 wt %, from 0.001 wt % to about 0.003 wt %, from 0.001 wt % to about 0.002 wt %, from 0.002 wt % to about 0.015 wt %, from 0.002 wt % to about 0.014 wt %, from 0.002 wt % to about 0.013 wt %, from 0.002 wt % to about 0.012 wt %, from 0.002 wt % to about 0.011 wt %, from 0.002 wt % to about 0.01 wt %, from 0.002 wt % to about 0.009 wt %, from 0.002 wt % to about 0.008 wt %, from 0.002 wt % to about 0.007 wt %, from 0.002 wt % to about 0.006 wt %, from 0.002 wt % to about 0.005 wt %, from 0.002 wt % to about 0.004 wt %, from 0.002 wt % to about 0.003 wt %, from 0.003 wt % to about 0.015 wt %, from 0.003 wt % to about 0.014 wt %, from 0.003 wt % to about 0.013 wt %, from 0.003 wt % to about 0.012 wt %, from 0.003 wt % to about 0.011 wt %, from 0.003 wt % to about 0.01 wt %, from 0.003 wt % to about 0.009 wt %, from 0.003 wt % to about 0.008 wt %, from 0.003 wt % to about 0.007 wt %, from 0.003 wt % to about 0.006 wt %, from 0.003 wt % to about 0.005 wt %, from 0.003 wt % to about 0.004 wt %, from 0.004 wt % to about 0.015 wt %, from 0.004 wt % to about 0.014 wt %, from 0.004 wt % to about 0.013 wt %, from 0.004 wt % to about 0.012 wt %, from 0.004 wt % to about 0.011 wt %, from 0.004 wt % to about 0.01 wt %, from 0.004 wt % to about 0.009 wt %, from 0.004 wt % to about 0.008 wt %, from 0.004 wt % to about 0.007 wt %, from 0.004 wt % to about 0.006 wt %, from 0.004 wt % to about 0.005 wt %, from 0.005 wt % to about 0.015 wt %, from 0.005 wt % to about 0.014 wt %, from 0.005 wt % to about 0.013 wt %, from 0.005 wt % to about 0.012 wt %, from 0.005 wt % to about 0.011 wt %, from 0.005 wt % to about 0.01 wt %, from 0.005 wt % to about 0.009 wt %, from 0.005 wt % to about 0.008 wt %, from 0.005 wt % to about 0.007 wt %, from 0.005 wt % to about 0.006 wt %, from 0.006 wt % to about 0.015 wt %, from 0.006 wt % to about 0.014 wt %, from 0.006 wt % to about 0.013 wt %, from 0.006 wt % to about 0.012 wt %, from 0.006 wt % to about 0.011 wt %, from 0.006 wt % to about 0.01 wt %, from 0.006 wt % to about 0.009 wt %, from 0.006 wt % to about 0.008 wt %, from 0.006 wt % to about 0.007 wt %, from 0.007 wt % to about 0.015 wt %, from 0.007 wt % to about 0.014 wt %, from 0.007 wt % to about 0.013 wt %, from 0.007 wt % to about 0.012 wt %, from 0.007 wt % to about 0.011 wt %, from 0.007 wt % to about 0.01 wt %, from 0.007 wt % to about 0.009 wt %, from 0.007 wt % to about 0.008 wt %, from 0.008 wt % to about 0.015 wt %, from 0.008 wt % to about 0.014 wt %, from 0.008 wt % to about 0.013 wt %, from 0.008 wt % to about 0.012 wt %, from 0.008 wt % to about 0.011 wt %, from 0.008 wt % to about 0.01 wt %, from 0.008 wt % to about 0.009 wt %, from 0.009 wt % to about 0.015 wt %, from 0.009 wt % to about 0.014 wt %, from 0.009 wt % to about 0.013 wt %, from 0.009 wt % to about 0.012 wt %, from 0.009 wt % to about 0.011 wt %, from 0.009 wt % to about 0.01 wt %, from 0.01 wt % to about 0.015 wt %, from 0.01 wt % to about 0.014 wt %, from 0.01 wt % to about 0.013 wt %, from 0.01 wt % to about 0.012 wt %, from 0.01 wt % to about 0.011 wt %, from 0.011 wt % to about 0.015 wt %, from 0.011 wt % to about 0.014 wt %, from 0.011 wt % to about 0.013 wt %, from 0.011 wt % to about 0.012 wt %, from 0.012 wt % to about 0.015 wt %, from 0.012 wt % to about 0.014 wt %, from 0.012 wt % to about 0.013 wt %, from 0.013 wt % to about 0.015 wt %, from 0.013 wt % to about 0.014 wt %, and from 0.014 wt % to about 0.015 wt %.

In certain embodiments the magnetic iron alloy includes copper in amounts: up to about 0.05 wt %, up to about 0.04 wt %, up to about 0.03 wt %, up to about 0.02 wt %, and up to about 0.01 wt %. The magnetic alloy may also include copper in the range of: from 0.001 wt % to about 0.05 wt %, from 0.001 wt % to about 0.04 wt %, from 0.001 wt % to about 0.03 wt %, from 0.001 wt % to about 0.02 wt %, from 0.001 wt % to about 0.01 wt %, from about 0.005 wt % to about 0.05 wt %, from about 0.005 wt % to about 0.04 wt %, from about 0.005 wt % to about 0.03 wt %, from about 0.005 wt % to about 0.02 wt %, from about 0.005 wt % to about 0.01 wt %, from about 0.01 wt % to about 0.05 wt %, from about 0.01 wt % to about 0.04 wt %, from about 0.01 wt % to about 0.03 wt %, from about 0.01 wt % to about 0.02 wt %, from about 0.015 wt % to about 0.05 wt %, from about 0.015 wt % to about 0.04 wt %, from about 0.015 wt % to about 0.03 wt %, from about 0.015 wt % to about 0.02 wt %, from about 0.02 wt % to about 0.05 wt %, from about 0.02 wt % to about 0.04 wt %, from about 0.02 wt % to about 0.03 wt %, from about 0.025 wt % to about 0.05 wt %, from about 0.025 wt % to about 0.04 wt %, from about 0.025 wt % to about 0.03 wt %, from about 0.03 wt % to about 0.05 wt %, from about 0.03 wt % to about 0.04 wt %, from about 0.035 wt % to about 0.05 wt %, from about 0.035 wt % to about 0.04 wt %, from about 0.04 wt % to about 0.05 wt %, and from about 0.045 wt % to about 0.05 wt %.

In certain embodiments the magnetic iron alloy includes titanium in amounts: up to about 0.05 wt %, up to about 0.04 wt %, up to about 0.03 wt %, up to about 0.02 wt %, and up to about 0.01 wt %. The magnetic alloy may also include titanium in the range of: from 0.001 wt % to about 0.05 wt %, from 0.001 wt % to about 0.04 wt %, from 0.001 wt % to about 0.03 wt %, from 0.001 wt % to about 0.02 wt %, from 0.001 wt % to about 0.01 wt %, from about 0.005 wt % to about 0.05 wt %, from about 0.005 wt % to about 0.04 wt %, from about 0.005 wt % to about 0.03 wt %, from about 0.005 wt % to about 0.02 wt %, from about 0.005 wt % to about 0.01 wt %, from about 0.01 wt % to about 0.05 wt %, from about 0.01 wt % to about 0.04 wt %, from about 0.01 wt % to about 0.03 wt %, from about 0.01 wt % to about 0.02 wt %, from about 0.015 wt % to about 0.05 wt %, from about 0.015 wt % to about 0.04 wt %, from about 0.015 wt % to about 0.03 wt %, from about 0.015 wt % to about 0.02 wt %, from about 0.02 wt % to about 0.05 wt %, from about 0.02 wt % to about 0.04 wt %, from about 0.02 wt % to about 0.03 wt %, from about 0.025 wt % to about 0.05 wt %, from about 0.025 wt % to about 0.04 wt %, from about 0.025 wt % to about 0.03 wt %, from about 0.03 wt % to about 0.05 wt %, from about 0.03 wt % to about 0.04 wt %, from about 0.035 wt % to about 0.05 wt %, from about 0.035 wt % to about 0.04 wt %, from about 0.04 wt % to about 0.05 wt %, and from about 0.045 wt % to about 0.05 wt %.

In certain embodiments the magnetic iron alloy includes molybdenum in amounts: up to about 0.05 wt %, up to about 0.04 wt %, up to about 0.03 wt %, up to about 0.02 wt %, and up to about 0.01 wt %. The magnetic alloy may also include molybdenum in the range of: from 0.001 wt % to about 0.05 wt %, from 0.001 wt % to about 0.04 wt %, from 0.001 wt % to about 0.03 wt %, from 0.001 wt % to about 0.02 wt %, from 0.001 wt % to about 0.01 wt %, from about 0.005 wt % to about 0.05 wt %, from about 0.005 wt % to about 0.04 wt %, from about 0.005 wt % to about 0.03 wt %, from about 0.005 wt % to about 0.02 wt %, from about 0.005 wt % to about 0.01 wt %, from about 0.01 wt % to about 0.05 wt %, from about 0.01 wt % to about 0.04 wt %, from about 0.01 wt % to about 0.03 wt %, from about 0.01 wt % to about 0.02 wt %, from about 0.015 wt % to about 0.05 wt %, from about 0.015 wt % to about 0.04 wt %, from about 0.015 wt % to about 0.03 wt %, from about 0.015 wt % to about 0.02 wt %, from about 0.02 wt % to about 0.05 wt %, from about 0.02 wt % to about 0.04 wt %, from about 0.02 wt % to about 0.03 wt %, from about 0.025 wt % to about 0.05 wt %, from about 0.025 wt % to about 0.04 wt %, from about 0.025 wt % to about 0.03 wt %, from about 0.03 wt % to about 0.05 wt %, from about 0.03 wt % to about 0.04 wt %, from about 0.035 wt % to about 0.05 wt %, from about 0.035 wt % to about 0.04 wt %, from about 0.04 wt % to about 0.05 wt %, and from about 0.045 wt % to about 0.05 wt %.

In certain embodiments the magnetic iron alloy includes phosphorus in amounts: up to about 0.05 wt %, up to about 0.04 wt %, up to about 0.03 wt %, up to about 0.02 wt %, and up to about 0.01 wt %. The magnetic alloy may also include phosphorus in the range of: from 0.001 wt % to about 0.05 wt %, from 0.001 wt % to about 0.04 wt %, from 0.001 wt % to about 0.03 wt %, from 0.001 wt % to about 0.02 wt %, from 0.001 wt % to about 0.01 wt %, from about 0.005 wt % to about 0.05 wt %, from about 0.005 wt % to about 0.04 wt %, from about 0.005 wt % to about 0.03 wt %, from about 0.005 wt % to about 0.02 wt %, from about 0.005 wt % to about 0.01 wt %, from about 0.01 wt % to about 0.05 wt %, from about 0.01 wt % to about 0.04 wt %, from about 0.01 wt % to about 0.03 wt %, from about 0.01 wt % to about 0.02 wt %, from about 0.015 wt % to about 0.05 wt %, from about 0.015 wt % to about 0.04 wt %, from about 0.015 wt % to about 0.03 wt %, from about 0.015 wt % to about 0.02 wt %, from about 0.02 wt % to about 0.05 wt %, from about 0.02 wt % to about 0.04 wt %, from about 0.02 wt % to about 0.03 wt %, from about 0.025 wt % to about 0.05 wt %, from about 0.025 wt % to about 0.04 wt %, from about 0.025 wt % to about 0.03 wt %, from about 0.03 wt % to about 0.05 wt %, from about 0.03 wt % to about 0.04 wt %, from about 0.035 wt % to about 0.05 wt %, from about 0.035 wt % to about 0.04 wt %, from about 0.04 wt % to about 0.05 wt %, and from about 0.045 wt % to about 0.05 wt %.

In certain embodiments the magnetic iron alloy includes aluminum in amounts: up to about 0.15 wt %, up to about 0.14 wt %, up to about 0.13 wt %, up to about 0.12 wt %, up to about 0.11 wt %, up to about 0.1 wt %, up to about 0.09 wt %, up to about 0.08 wt %, up to about 0.07 wt %, up to about 0.06 wt %, up to about 0.05 wt %, up to about 0.04 wt %, up to about 0.03 wt %, up to about 0.02 wt %, and up to about 0.01 wt %. The magnetic alloy may also include aluminum in the range of: from 0.001 wt % to about 0.15 wt %, from 0.001 wt % to about 0.14 wt %, from 0.001 wt % to about 0.13 wt %, from 0.001 wt % to about 0.12 wt %, from 0.001 wt % to about 0.11 wt %, from 0.001 wt % to about 0.1 wt %, from 0.001 wt % to about 0.09 wt %, from 0.001 wt % to about 0.08 wt %, from 0.001 wt % to about 0.07 wt %, from 0.001 wt % to about 0.06 wt %, from 0.001 wt % to about 0.05 wt %, from 0.001 wt % to about 0.04 wt %, from 0.001 wt % to about 0.03 wt %, from 0.001 wt % to about 0.02 wt %, from 0.001 wt % to about 0.01 wt %, from about 0.01 wt % to about 0.15 wt %, from about 0.01 wt % to about 0.14 wt %, from about 0.01 wt % to about 0.13 wt %, from about 0.01 wt % to about 0.12 wt %, from about 0.01 wt % to about 0.11 wt %, from about 0.01 wt % to about 0.1 wt %, from about 0.01 wt % to about 0.09 wt %, from about 0.01 wt % to about 0.08 wt %, from about 0.01 wt % to about 0.07 wt %, from about 0.01 wt % to about 0.06 wt %, from about 0.01 wt % to about 0.05 wt %, from about 0.01 wt % to about 0.04 wt %, from about 0.01 wt % to about 0.03 wt %, from about 0.01 wt % to about 0.02 wt %, from about 0.02 wt % to about 0.15 wt %, from about 0.02 wt % to about 0.14 wt %, from about 0.02 wt % to about 0.13 wt %, from about 0.02 wt % to about 0.12 wt %, from about 0.02 wt % to about 0.11 wt %, from about 0.02 wt % to about 0.1 wt %, from about 0.02 wt % to about 0.09 wt %, from about 0.02 wt % to about 0.08 wt %, from about 0.02 wt % to about 0.07 wt %, from about 0.02 wt % to about 0.06 wt %, from about 0.02 wt % to about 0.05 wt %, from about 0.02 wt % to about 0.04 wt %, from about 0.02 wt % to about 0.03 wt %, from about 0.03 wt % to about 0.15 wt %, from about 0.03 wt % to about 0.14 wt %, from about 0.03 wt % to about 0.13 wt %, from about 0.03 wt % to about 0.12 wt %, from about 0.03 wt % to about 0.11 wt %, from about 0.03 wt % to about 0.1 wt %, from about 0.03 wt % to about 0.09 wt %, from about 0.03 wt % to about 0.08 wt %, from about 0.03 wt % to about 0.07 wt %, from about 0.03 wt % to about 0.06 wt %, from about 0.03 wt % to about 0.05 wt %, from about 0.03 wt % to about 0.04 wt %, from about 0.04 wt % to about 0.15 wt %, from about 0.04 wt % to about 0.14 wt %, from about 0.04 wt % to about 0.13 wt %, from about 0.04 wt % to about 0.12 wt %, from about 0.04 wt % to about 0.11 wt %, from about 0.04 wt % to about 0.1 wt %, from about 0.04 wt % to about 0.09 wt %, from about 0.04 wt % to about 0.08 wt %, from about 0.04 wt % to about 0.07 wt %, from about 0.04 wt % to about 0.06 wt %, from about 0.04 wt % to about 0.05 wt % from about 0.05 wt % to about 0.15 wt %, from about 0.05 wt % to about 0.14 wt %, from about 0.05 wt % to about 0.13 wt %, from about 0.05 wt % to about 0.12 wt %, from about 0.05 wt % to about 0.11 wt %, from about 0.05 wt % to about 0.1 wt %, from about 0.05 wt % to about 0.09 wt %, from about 0.05 wt % to about 0.08 wt %, from about 0.05 wt % to about 0.07 wt %, from about 0.05 wt % to about 0.06 wt % from about 0.06 wt % to about 0.15 wt %, from about 0.06 wt % to about 0.14 wt %, from about 0.06 wt % to about 0.13 wt %, from about 0.06 wt % to about 0.12 wt %, from about 0.06 wt % to about 0.11 wt %, from about 0.06 wt % to about 0.1 wt %, from about 0.06 wt % to about 0.09 wt %, from about 0.06 wt % to about 0.08 wt %, from about 0.06 wt % to about 0.07 wt %, from about 0.07 wt % to about 0.15 wt %, from about 0.07 wt % to about 0.14 wt %, from about 0.07 wt % to about 0.13 wt %, from about 0.07 wt % to about 0.12 wt %, from about 0.07 wt % to about 0.11 wt %, from about 0.07 wt % to about 0.1 wt %, from about 0.07 wt % to about 0.09 wt %, from about 0.07 wt % to about 0.08 wt % from about 0.08 wt % to about 0.15 wt %, from about 0.08 wt % to about 0.14 wt %, from about 0.08 wt % to about 0.13 wt %, from about 0.08 wt % to about 0.12 wt %, from about 0.08 wt % to about 0.11 wt %, from about 0.08 wt % to about 0.1 wt %, from about 0.08 wt % to about 0.09 wt %, from about 0.09 wt % to about 0.15 wt %, from about 0.09 wt % to about 0.14 wt %, from about 0.09 wt % to about 0.13 wt %, from about 0.09 wt % to about 0.12 wt %, from about 0.09 wt % to about 0.11 wt %, from about 0.09 wt % to about 0.1 wt %, from about 0.1 wt % to about 0.15 wt %, from about 0.1 wt % to about 0.14 wt %, from about 0.1 wt % to about 0.13 wt %, from about 0.1 wt % to about 0.12 wt %, from about 0.1 wt % to about 0.11 wt %, from about 0.11 wt % to about 0.15 wt %, from about 0.11 wt % to about 0.14 wt %, from about 0.11 wt % to about 0.13 wt %, from about 0.11 wt % to about 0.12 wt %, from about 0.12 wt % to about 0.15 wt %, from about 0.12 wt % to about 0.14 wt %, from about 0.12 wt % to about 0.13 wt %, from about 0.13 wt % to about 0.15 wt %, from about 0.13 wt % to about 0.14 wt %, and from about 0.14 wt % to about 0.15 wt %.

In certain embodiments the magnetic iron alloy includes zirconium in amounts: up to about 0.1 wt %, up to about 0.09 wt %, up to about 0.08 wt %, up to about 0.07 wt %, up to about 0.06 wt %, up to about 0.05 wt %, up to about 0.04 wt %, up to about 0.03 wt %, up to about 0.02 wt %, and up to about 0.01 wt %. The magnetic alloy may also include zirconium in the range of: from 0.001 wt % to about 0.1 wt %, from 0.001 wt % to about 0.09 wt %, from 0.001 wt % to about 0.08 wt %, from 0.001 wt % to about 0.07 wt %, from 0.001 wt % to about 0.06 wt %, from 0.001 wt % to about 0.05 wt %, from 0.001 wt % to about 0.04 wt %, from 0.001 wt % to about 0.03 wt %, from 0.001 wt % to about 0.02 wt %, from 0.001 wt % to about 0.01 wt %, from about 0.01 wt % to about 0.1 wt %, from about 0.01 wt % to about 0.09 wt %, from about 0.01 wt % to about 0.08 wt %, from about 0.01 wt % to about 0.07 wt %, from about 0.01 wt % to about 0.06 wt %, from about 0.01 wt % to about 0.05 wt %, from about 0.01 wt % to about 0.04 wt %, from about 0.01 wt % to about 0.03 wt %, from about 0.01 wt % to about 0.02 wt %, from about 0.02 wt % to about 0.1 wt %, from about 0.02 wt % to about 0.09 wt %, from about 0.02 wt % to about 0.08 wt %, from about 0.02 wt % to about 0.07 wt %, from about 0.02 wt % to about 0.06 wt %, from about 0.02 wt % to about 0.05 wt %, from about 0.02 wt % to about 0.04 wt %, from about 0.02 wt % to about 0.03 wt %, from about 0.03 wt % to about 0.15 wt %, from about 0.03 wt % to about 0.14 wt %, from about 0.03 wt % to about 0.13 wt %, from about 0.03 wt % to about 0.12 wt %, from about 0.03 wt % to about 0.11 wt %, from about 0.03 wt % to about 0.1 wt %, from about 0.03 wt % to about 0.09 wt %, from about 0.03 wt % to about 0.08 wt %, from about 0.03 wt % to about 0.07 wt %, from about 0.03 wt % to about 0.06 wt %, from about 0.03 wt % to about 0.05 wt %, from about 0.03 wt % to about 0.04 wt %, from about 0.04 wt % to about 0.15 wt %, from about 0.04 wt % to about 0.14 wt %, from about 0.04 wt % to about 0.13 wt %, from about 0.04 wt % to about 0.12 wt %, from about 0.04 wt % to about 0.11 wt %, from about 0.04 wt % to about 0.1 wt 0.04 wt %, from about 0.02 wt % to about 0.03 wt %, from about 0.03 wt % to about 0.1 wt %, from about 0.03 wt % to about 0.09 wt %, from about 0.03 wt % to about 0.08 wt %, from about 0.03 wt % to about 0.07 wt %, from about 0.03 wt % to about 0.06 wt %, from about 0.03 wt % to about 0.05 wt %, from about 0.03 wt % to about 0.04 wt %, from about 0.04 wt % to about 0.1 wt %, from about 0.04 wt % to about 0.09 wt %, from about 0.04 wt % to about 0.08 wt %, from about 0.04 wt % to about 0.07 wt %, from about 0.04 wt % to about 0.06 wt %, from about 0.04 wt % to about 0.05 wt %, from about 0.05 wt % to about 0.1 wt %, from about 0.05 wt % to about 0.09 wt %, from about 0.05 wt % to about 0.08 wt %, from about 0.05 wt % to about 0.07 wt %, from about 0.05 wt % to about 0.06 wt %, from about 0.06 wt % to about 0.1 wt %, from about 0.06 wt % to about 0.09 wt %, from about 0.06 wt % to about 0.08 wt %, from about 0.06 wt % to about 0.07 wt %, from about 0.07 wt % to about 0.1 wt %, from about 0.07 wt % to about 0.09 wt %, from about 0.07 wt % to about 0.08 wt %, from about 0.08 wt % to about 0.1 wt %, from about 0.08 wt % to about 0.09 wt %, and from about 0.09 wt % to about 0.1 wt %.

In certain embodiments the magnetic iron alloy includes gadolinium in amounts: up to about 0.15 wt %, up to about 0.14 wt %, up to about 0.13 wt %, up to about 0.12 wt %, up to about 0.11 wt %, up to about 0.1 wt %, up to about 0.09 wt %, up to about 0.08 wt %, up to about 0.07 wt %, up to about 0.06 wt %, up to about 0.05 wt %, up to about 0.04 wt %, up to about 0.03 wt %, up to about 0.02 wt %, and up to about 0.01 wt %. The magnetic alloy may also include gadolinium in the range of: from 0.001 wt % to about 0.15 wt %, from 0.001 wt % to about 0.14 wt %, from 0.001 wt % to about 0.13 wt %, from 0.001 wt % to about 0.12 wt %, from 0.001 wt % to about 0.11 wt %, from 0.001 wt % to about 0.1 wt %, from 0.001 wt % to about 0.09 wt %, from 0.001 wt % to about 0.08 wt %, from 0.001 wt % to about 0.07 wt %, from 0.001 wt % to about 0.06 wt %, from 0.001 wt % to about 0.05 wt %, from 0.001 wt % to about 0.04 wt %, from 0.001 wt % to about 0.03 wt %, from 0.001 wt % to about 0.02 wt %, from 0.001 wt % to about 0.01 wt %, from about 0.01 wt % to about 0.15 wt %, from about 0.01 wt % to about 0.14 wt %, from about 0.01 wt % to about 0.13 wt %, from about 0.01 wt % to about 0.12 wt %, from about 0.01 wt % to about 0.11 wt %, from about 0.01 wt % to about 0.1 wt %, from about 0.01 wt % to about 0.09 wt %, from about 0.01 wt % to about 0.08 wt %, from about 0.01 wt % to about 0.07 wt %, from about 0.01 wt % to about 0.06 wt %, from about 0.01 wt % to about 0.05 wt %, from about 0.01 wt % to about 0.04 wt %, from about 0.01 wt % to about 0.03 wt %, from about 0.01 wt % to about 0.02 wt %, from about 0.02 wt % to about 0.15 wt %, from about 0.02 wt % to about 0.14 wt %, from about 0.02 wt % to about 0.13 wt %, from about 0.02 wt % to about 0.12 wt %, from about 0.02 wt % to about 0.11 wt %, from about 0.02 wt % to about 0.1 wt %, from about 0.02 wt % to about 0.09 wt %, from about 0.02 wt % to about 0.08 wt %, from about 0.02 wt % to about 0.07 wt %, from about 0.02 wt % to about 0.06 wt %, from about 0.02 wt % to about 0.05 wt %, from about 0.02 wt % to about 0.04 wt %, from about 0.02 wt % to about 0.03 wt %, from about 0.03 wt % to about 0.15 wt %, from about 0.03 wt % to about 0.14 wt %, from about 0.03 wt % to about 0.13 wt %, from about 0.03 wt % to about 0.12 wt %, from about 0.03 wt % to about 0.11 wt %, from about 0.03 wt % to about 0.1 wt %, from about 0.03 wt % to about 0.09 wt %, from about 0.03 wt % to about 0.08 wt %, from about 0.03 wt % to about 0.07 wt %, from about 0.03 wt % to about 0.06 wt %, from about 0.03 wt % to about 0.05 wt %, from about 0.03 wt % to about 0.04 wt %, from about 0.04 wt % to about 0.15 wt %, from about 0.04 wt % to about 0.14 wt %, from about 0.04 wt % to about 0.13 wt %, from about 0.04 wt % to about 0.12 wt %, from about 0.04 wt % to about 0.11 wt %, from about 0.04 wt % to about 0.1 wt %, from about 0.04 wt % to about 0.09 wt %, from about 0.04 wt % to about 0.08 wt %, from about 0.04 wt % to about 0.07 wt %, from about 0.04 wt % to about 0.06 wt %, from about 0.04 wt % to about 0.05 wt % from about 0.05 wt % to about 0.15 wt %, from about 0.05 wt % to about 0.14 wt %, from about 0.05 wt % to about 0.13 wt %, from about 0.05 wt % to about 0.12 wt %, from about 0.05 wt % to about 0.11 wt %, from about 0.05 wt % to about 0.1 wt %, from about 0.05 wt % to about 0.09 wt %, from about 0.05 wt % to about 0.08 wt %, from about 0.05 wt % to about 0.07 wt %, from about 0.05 wt % to about 0.06 wt % from about 0.06 wt % to about 0.15 wt %, from about 0.06 wt % to about 0.14 wt %, from about 0.06 wt % to about 0.13 wt %, from about 0.06 wt % to about 0.12 wt %, from about 0.06 wt % to about 0.11 wt %, from about 0.06 wt % to about 0.1 wt %, from about 0.06 wt % to about 0.09 wt %, from about 0.06 wt % to about 0.08 wt %, from about 0.06 wt % to about 0.07 wt %, from about 0.07 wt % to about 0.15 wt %, from about 0.07 wt % to about 0.14 wt %, from about 0.07 wt % to about 0.13 wt %, from about 0.07 wt % to about 0.12 wt %, from about 0.07 wt % to about 0.11 wt %, from about 0.07 wt % to about 0.1 wt %, from about 0.07 wt % to about 0.09 wt %, from about 0.07 wt % to about 0.08 wt % from about 0.08 wt % to about 0.15 wt %, from about 0.08 wt % to about 0.14 wt %, from about 0.08 wt % to about 0.13 wt %, from about 0.08 wt % to about 0.12 wt %, from about 0.08 wt % to about 0.11 wt %, from about 0.08 wt % to about 0.1 wt %, from about 0.08 wt % to about 0.09 wt %, from about 0.09 wt % to about 0.15 wt %, from about 0.09 wt % to about 0.14 wt %, from about 0.09 wt % to about 0.13 wt %, from about 0.09 wt % to about 0.12 wt %, from about 0.09 wt % to about 0.11 wt %, from about 0.09 wt % to about 0.1 wt %, from about 0.1 wt % to about 0.15 wt %, from about 0.1 wt % to about 0.14 wt %, from about 0.1 wt % to about 0.13 wt %, from about 0.1 wt % to about 0.12 wt %, from about 0.1 wt % to about 0.11 wt %, from about 0.11 wt % to about 0.15 wt %, from about 0.11 wt % to about 0.14 wt %, from about 0.11 wt % to about 0.13 wt %, from about 0.11 wt % to about 0.12 wt %, from about 0.12 wt % to about 0.15 wt %, from about 0.12 wt % to about 0.14 wt %, from about 0.12 wt % to about 0.13 wt %, from about 0.13 wt % to about 0.15 wt %, from about 0.13 wt % to about 0.14 wt %, and from about 0.14 wt % to about 0.15 wt %.

In certain embodiments the magnetic iron alloy includes cerium in amounts: up to about 0.05 wt %, up to about 0.04 wt %, up to about 0.03 wt %, up to about 0.02 wt %, up to about 0.01 wt %. The magnetic alloy may also include cerium in the range of: from 0.001 wt % to about 0.05 wt %, from 0.001 wt % to about 0.04 wt %, from 0.001 wt % to about 0.03 wt %, from 0.001 wt % to about 0.02 wt %, from 0.001 wt % to about 0.01 wt %, from about 0.005 wt % to about 0.05 wt %, from about 0.005 wt % to about 0.04 wt %, from about 0.005 wt % to about 0.03 wt %, from about 0.005 wt % to about 0.02 wt %, from about 0.005 wt % to about 0.01 wt %, from about 0.01 wt % to about 0.05 wt %, from about 0.01 wt % to about 0.04 wt %, from about 0.01 wt % to about 0.03 wt %, from about 0.01 wt % to about 0.02 wt %, from about 0.015 wt % to about 0.05 wt %, from about 0.015 wt % to about 0.04 wt %, from about 0.015 wt % to about 0.03 wt %, from about 0.015 wt % to about 0.02 wt %, from about 0.02 wt % to about 0.05 wt %, from about 0.02 wt % to about 0.04 wt %, from about 0.02 wt % to about 0.03 wt %, from about 0.025 wt % to about 0.05 wt %, from about 0.025 wt % to about 0.04 wt %, from about 0.025 wt % to about 0.03 wt %, from about 0.03 wt % to about 0.05 wt %, from about 0.03 wt % to about 0.04 wt %, from about 0.035 wt % to about 0.05 wt %, from about 0.035 wt % to about 0.04 wt %, from about 0.04 wt % to about 0.05 wt %, and from about 0.045 wt % to about 0.05 wt %.

In certain embodiments the magnetic iron alloy includes calcium in amounts: up to about 0.05 wt %, up to about 0.04 wt %, up to about 0.03 wt %, up to about 0.02 wt %, up to about 0.01 wt %. The magnetic alloy may also include calcium in the range of: from 0.001 wt % to about 0.05 wt %, from 0.001 wt % to about 0.04 wt %, from 0.001 wt % to about 0.03 wt %, from 0.001 wt % to about 0.02 wt %, from 0.001 wt % to about 0.01 wt %, from about 0.005 wt % to about 0.05 wt %, from about 0.005 wt % to about 0.04 wt %, from about 0.005 wt % to about 0.03 wt %, from about 0.005 wt % to about 0.02 wt %, from about 0.005 wt % to about 0.01 wt %, from about 0.01 wt % to about 0.05 wt %, from about 0.01 wt % to about 0.04 wt %, from about 0.01 wt % to about 0.03 wt %, from about 0.01 wt % to about 0.02 wt %, from about 0.015 wt % to about 0.05 wt %, from about 0.015 wt % to about 0.04 wt %, from about 0.015 wt % to about 0.03 wt %, from about 0.015 wt % to about 0.02 wt %, from about 0.02 wt % to about 0.05 wt %, from about 0.02 wt % to about 0.04 wt %, from about 0.02 wt % to about 0.03 wt %, from about 0.025 wt % to about 0.05 wt %, from about 0.025 wt % to about 0.04 wt %, from about 0.025 wt % to about 0.03 wt %, from about 0.03 wt % to about 0.05 wt %, from about 0.03 wt % to about 0.04 wt %, from about 0.035 wt % to about 0.05 wt %, from about 0.035 wt % to about 0.04 wt %, from about 0.04 wt % to about 0.05 wt %, and from about 0.045 wt % to about 0.05 wt %.

The alloy may also include other minimal impurities that do not affect the magnetic, electrical, and mechanical properties of the alloy The magnetic iron alloy including the alloying elements described above can provide for a single alpha ($\alpha$), ferrite body-centered cubic phase alloy. In an exemplary embodiment, the magnetic iron alloy is primarily or substantially $\alpha$-phase (e.g., >95%). Preferably, the magnetic iron alloy comprises predominately a phase (e.g., >99%), with little or no secondary phases present. $\alpha$-phase alloys may provide the advantage of minimum core loss and relatively high ductility. In addition, magnetic iron alloys according to embodiments of the invention are designed to provide superior electrical resistivity and magnetic properties.

The magnetic iron alloys according to embodiments of the invention preferably possess a high magnetic saturation induction ($B_s$), or flux density, of at least approximately 20 kilogauss (kG); a low coercivity ($H_c$) of less than approximately 2 oersteds (Oe), and a high electrical resistivity ($\rho$) of at least 40 $\mu\Omega$cm. Saturation is the state reached when an increase in applied external magnetic field (H) cannot increase the magnetization of the material further, so the total magnetic flux density (B) more or less levels off. Saturation is a characteristic of ferromagnetic materials. The coercivity of a material is the intensity of the applied magnetic field required to reduce the magnetization of that material to zero after the magnetization of the sample has been driven to saturation. Thus, coercivity measures the resistance of a ferromagnetic material to becoming demagnetized. Coercivity can be measured using a B-H analyzer or magnetometer or coercimeter. Electrical resistivity is an intrinsic property that quantifies how strongly a given material opposes the flow of electric current. A low resistivity indicates a material that readily allows the movement of electric charge.

As can be seen from the working examples provided below, for the family of alloys having the concentrations of Co, Mn, and Si described above, $B_s$ is increased by an increase in Co concentration but decreased by an increase in Mn and Si concentrations; $H_c$ is increased by increases in Co and Mn concentration but decreased by an increase in Si concentration; and $\rho$ is increased by an increase in concentration of any of Si, Co, and Mn. Accordingly, the magnetic iron alloys according to embodiments of the invention may be advantageously tuned to a broad range of desired magnetic properties while maintaining low levels of Co, thereby reducing the cost of the alloy.

Process of Producing the Alloys

Embodiments of the invention further include processes for producing the magnetic iron alloy including cobalt, manganese, and silicon described above.

The alloy may be prepared, worked, and formed into products using conventional techniques. For example, the alloying elements can be melted in air or a suitable atmosphere, using an electric are furnace and vacuum melting techniques such as vacuum induction melting (VIM), vacuum arc remelting (VAR), electroslag remelting (ESR), or the like. When desired, higher purity or better grain structure can be obtained by refining the alloy, for example, by ESR or VAR.

The alloy may be cast into ingot form which is then hot worked into billet, bar, slab, or the like. The furnace temperature may range from approximately 1,000° F. (538° C.) to approximately 2,150° F. (1,177° C.), for example. The forms may be machined into useful parts and components, such as disks, journals, and shafts for magnetic bearings. Alternatively, the alloy may be further hot rolled to a wire, a rod, or a strip of a desired thickness. The wire, rod, or strip may also be cold worked to smaller cross-sectional dimensions from which it can be machined into finished parts. The alloy can also be made using powder metallurgy techniques.

In order to continue to fine tune the properties of the alloy, the process may further include a heat treatment in order to optimize the saturation induction, electrical resistivity, and mechanical values. The alloy may be heat treated in a single step or multiple step heat treatment cycle. In a single step heat treatment, the alloy may be heated to a first temperature and then cooled at a given rate to a desired temperature. In a multiple step heat treatment, the alloy may be heated to a first temperature, cooled to a given temperature, heated to a second temperature, and cooled to a given temperature. At any heating or cooling step, the temperature may be held for a given duration. This multiple step heat treatment may be repeated as many times as necessary to achieve the desired outcome and properties (i.e., magnetic, electrical, and mechanical) necessary for the application.

The heat treatment temperature, conditions, and duration may depend on the application and properties desired for the alloy. For example, the alloy or parts may be annealed at a temperature of approximately 1,300° F. (704° C.) to approximately 1,652° F. (900° C.) for approximately 2 hours to approximately 4 hours in a dry hydrogen or vacuum. The alloy may then be cooled at approximately 144° F. (62° C.) to approximately 540° F. (282° C.) per hour until a temperature of approximately 572° F. (300° C.) to approximately 600° F. (316° C.) is reached, and then cooled at any suitable rate. With increasing temperatures, the magnetic properties may improve while the yield strength and tensile strength decrease. It may be preferable that the temperature does not exceed approximately 1,652° F. (900° C.) because the soft magnetic characteristics may start to decline due to the formation of an austenitic phase. The magnetic properties may also be improved by creating a thin oxide layer on the surface of the alloy. The surface oxide layer may be achieved by heating in an oxygen-containing atmosphere, for example, at a temperature in the range of approximately 600° F. (316° C.) to approximately 900° F. (482° C.) for a time of approximately 30 to approximately 60 minutes.

Examples

The following examples are included to more clearly demonstrate the overall nature of the invention. These examples are exemplary, not restrictive, of the invention.

A number of samples were prepared including varying levels of Co, Mn, and Si by casting in a VIM furnace to form 35 lb. (16 kg) ingots, which were subsequently hot-forged into 2 inch (5 cm) square bars. The chemical composition of each sample is presented in Table 1. Each of the values in Table 1 are in weight percent. For each sample, the balance of the alloy is substantially Fe. The samples were grouped into three series of varying Co concentrations: a first series having approximately 10 wt. % Co (samples 1-3), a second series having approximately 8 wt. % Co (samples 4-8), and a third series having approximately 5 wt. % Co (samples 9-13). Sample 14 was prepared including substantially no cobalt as a control and corresponds approximately to Silicon Core Iron from Carpenter.

TABLE 1

| Sample | Co | Mn | Si | Cr | C | P | S | Ni | Mo |
|---|---|---|---|---|---|---|---|---|---|
| 1 | 10.00 | 2.71 | 0.25 | 0.09 | <0.001 | <0.005 | 0.0012 | <0.01 | <0.01 |
| 2 | 10.00 | 2.73 | 0.75 | 0.09 | <0.001 | <0.005 | 0.0013 | <0.01 | <0.01 |
| 3 | 9.98 | 2.73 | 1.23 | 0.09 | <0.001 | <0.005 | 0.0011 | <0.01 | <0.01 |
| 4 | 8.00 | 2.70 | 0.26 | 0.29 | <0.001 | <0.005 | 0.0012 | <0.01 | <0.01 |
| 5 | 8.00 | 2.21 | 0.26 | 0.29 | <0.001 | <0.005 | 0.0012 | <0.01 | <0.01 |
| 6 | 7.97 | 2.22 | 0.74 | 0.29 | <0.002 | <0.005 | 0.0012 | <0.01 | <0.01 |
| 7 | 7.99 | 2.22 | 1.25 | 0.29 | <0.001 | <0.005 | 0.0011 | <0.01 | <0.01 |
| 8 | 7.97 | 1.70 | 0.26 | 0.29 | <0.001 | <0.005 | 0.0010 | <0.01 | <0.01 |
| 9 | 5.05 | 2.66 | 0.21 | 0.28 | 0.011 | <0.005 | 0.0015 | <0.01 | <0.01 |
| 10 | 5.00 | 2.21 | 0.26 | 0.29 | <0.001 | <0.005 | 0.0013 | <0.01 | <0.01 |
| 11 | 4.98 | 2.22 | 0.75 | 0.29 | <0.001 | <0.005 | 0.0012 | <0.01 | <0.01 |
| 12 | 4.97 | 2.21 | 1.32 | 0.29 | <0.001 | <0.005 | 0.0013 | <0.01 | <0.01 |
| 13 | 4.99 | 1.03 | 2.31 | 0.29 | <0.001 | <0.005 | 0.0010 | <0.01 | <0.01 |
| 14 | 0.02 | 0.22 | 2.48 | <0.01 | 0.002 | <0.005 | 0.0007 | <0.01 | <0.01 |

Each 2 inch (5 cm) square bar was then processed by two different processing routes. First, a portion of each 2 inch (5 cm) square bar was subjected to subsequent hot forging to produce a 0.75 inch (1.9 cm) square bar followed by annealing to enhance magnetic properties. Each bar was annealed in dry hydrogen ($H_2$) at 2,156° F. (1,180° C.), cooled at a rate of 200° F. (93° C.) per hour to 1,290° F. (699° C.), and held at 1,290° F. (699° C.) for 24 hours. Each bar was then characterized for coercivity ($H_c$), magnetic induction at 250 Oe ($B_{250}$), magnetic induction saturation (Bs), electrical resistivity (ρ), hardness (Rockwell B) ($R_B$), yield strength (YS), ultimate tensile strength (UTS), elongation (El), and reduction in area (RA). The results are reported below in Table 2.

Figure 1B:
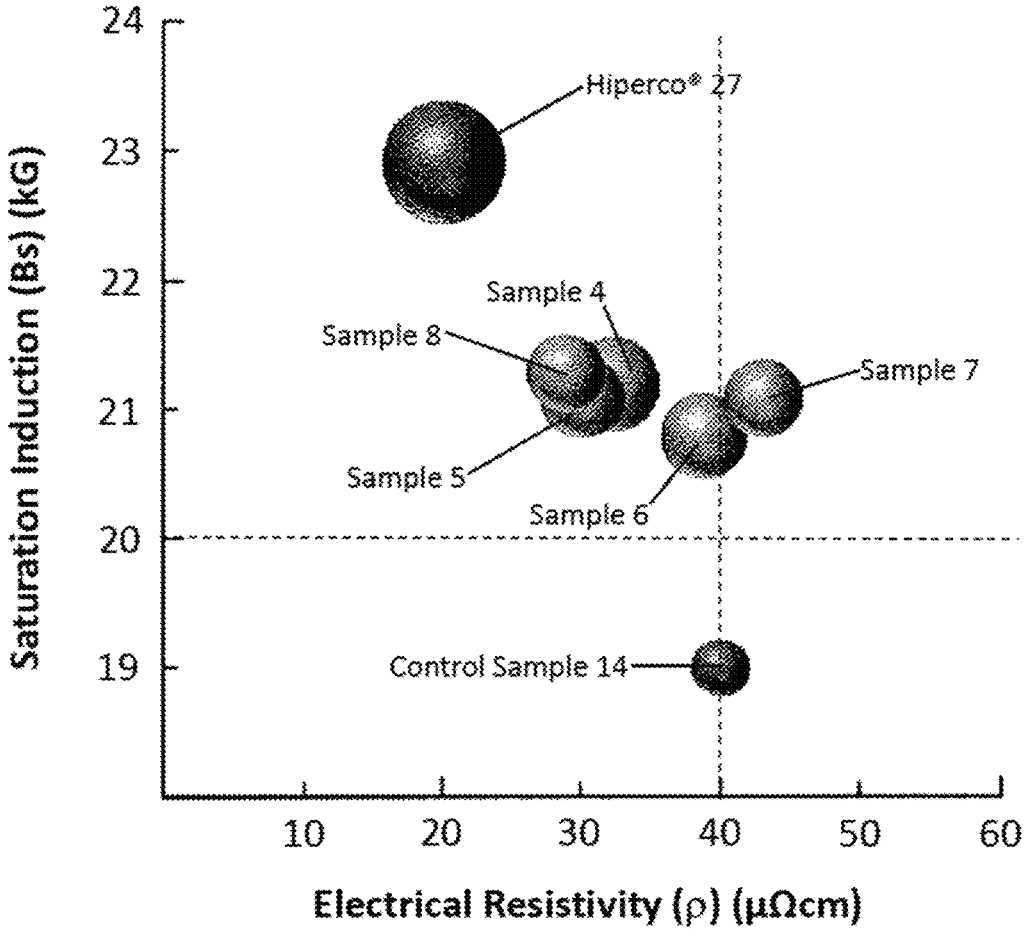
FIG. 1B is a graph depicting $B_s$, $H_c$, and ρ for a series of alloys having approximately 8 wt. % Co as compared to HIPERCO® 27 and a substantially Co-free control sample, according to embodiments of the invention.
Figure 1C:
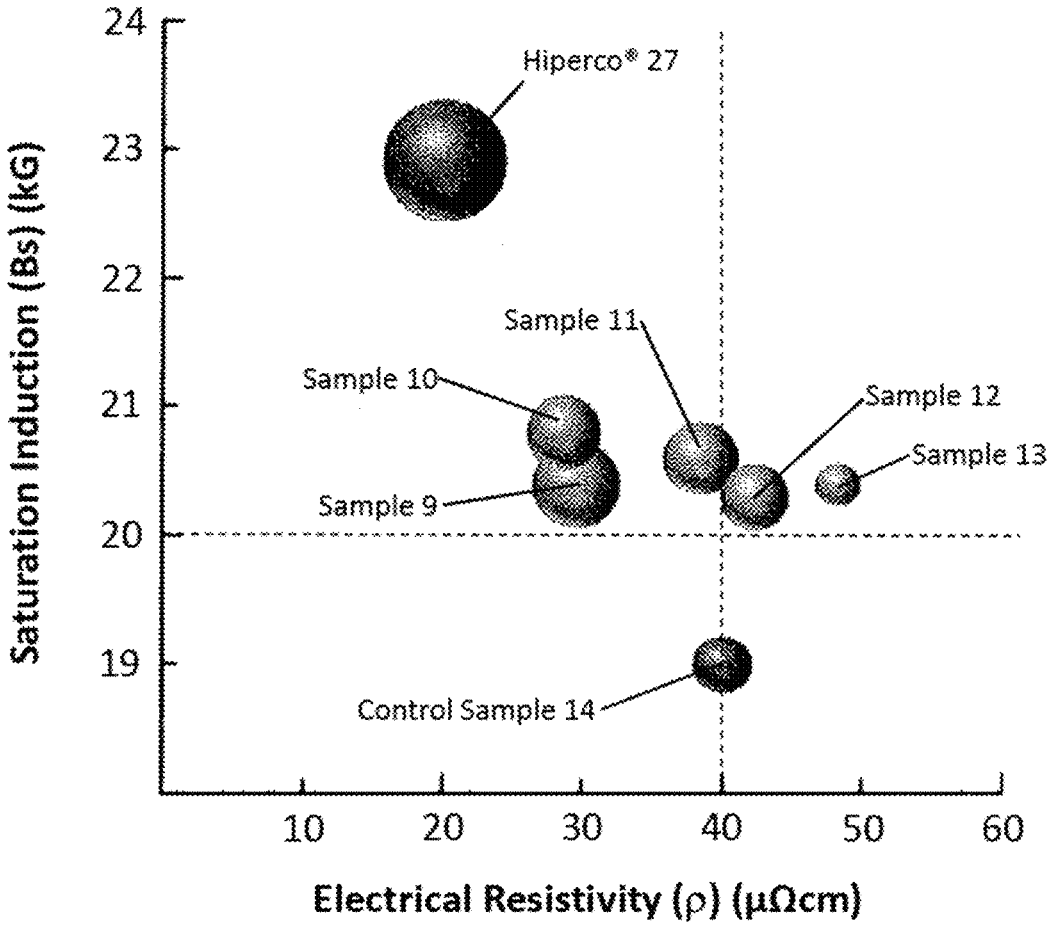
FIG. 1C is a graph depicting $B_s$, $H_c$, and ρ for a series of alloys having approximately 5 wt. % Co as compared to HIPERCO® 27 and a substantially Co-free control sample, according to embodiments of the invention.

FIGS. 1A-1C are graphs depicting the $H_c$, $B_s$, and ρ for each series of samples. FIG. 1A depicts the first series having approximately 10 wt. % Co (Samples 1-3), FIG. 1B depicts the second series having approximately 8 wt. % Co (Samples 4-8), and FIG. 1C depicts the third series having approximately 5 wt. % Co (Samples 9-13). In each figure, the size of each bubble is proportional to its coercivity and the respective samples are also compared to two alloys, HIPERCO® 27 from Carpenter and Control Sample 14, corresponding approximately to Silicon Core Iron, also from Carpenter. HIPERCO® 27 has a $B_s$ of approximately 20.0 kG and an $H_c$ of approximately 1.7 to approximately 3.0 Oe, but only an ρ of 19 μΩcm, not meeting the desired properties of a $B_s$ greater than 20 kG, a ρ greater than 40 μΩcm, and an $H_c$ of less than 2 Oe. In contrast, the Control Sample 14 has a ρ of 40 μΩcm and an Hr of 0.7 Oe, but only a $B_s$ of 19.8 kG, also not meeting the desired properties.

FIG. 1A depicts the three samples (Samples 1-3) having approximately 10 wt. % Co as compared to HIPERCO® 27 and Control Sample 14. Each of the three samples had a $B_s$ between Hiperco® 27 and Control Sample 14, and greater than desired $B_s$ of 20 kG. Each of the three samples also had a HE between HIPERCO® 27 and Control Sample 14, and met the desired $H_c$ of less than 2.0 Oe. However, only sample 3 (Co=9.98 wt. %, Mn=2.73 wt. %, and Si=1.23 wt. %) had the desired ρ of greater than 40 μΩcm. Among the alloys in this series, an increase in Si content (composition of other elements remaining constant) increases ρ, decreases $H_c$, and decreases $B_s$.

FIG. 1B depicts the five samples (Samples 4-8) having approximately 8 wt. % Co as compared to HIPERCO® 27

TABLE 2

| Sample | $H_c$ (Oe) | $B_{250}$ (kG) | $B_s$ (kG) | ρ (μΩcm) | $R_B$ | YS (ksi) | UTS (ksi) | El (%) | RA (%) |
|---|---|---|---|---|---|---|---|---|---|
| 1 | 1.43 (±0.09) | 20.7 (±0.1) | 21.3 (±0.1) | 34.8 (±0.1) | 67 (±1) | 33.7 (±0.1) | 58.2 (±1.5) | 44 (±1) | 83 (±3) |
| 2 | 1.30 (±0.02) | 20.5 (±0.1) | 21.1 (±0.1) | 40.9 (±0.7) | 74 (±1.5) | 40.9 (±0.2) | 65.2 (±0.2) | 42 (±1) | 81 (±4) |
| 3 | 1.36 (±0.02) | 20.3 (±0.1) | 20.9 (±0.1) | 45.3 (±0.6) | 82 (±1.5) | 48.9 (±0.2) | 69.7 (±0.1) | 40 (±1) | 76 (±3) |
| 4 | 1.27 (±0.05) | 20.7 (±0.2) | 21.2 (±0.3) | 32.2 (±1.4) | 64 (±1) | 30.2 (±0.1) | 53.2 (±0.3) | 47 (±1) | 84 (±3) |
| 5 | 0.97 (±0.05) | 20.5 (±0.1) | 21.1 (±0.1) | 29.9 (±0.6) | 60 (±1) | 26.2 (±0.1) | 52.5 (±0.2) | 49 (±4) | 85 (±4) |
| 6 | 0.90 (±0.02) | 20.3 (±0.2) | 20.8 (±0.3) | 38.8 (±0.6) | 69 (±1) | 35.2 (±0.1) | 60.3 (±0.1) | 45 (±1) | 85 (±1) |
| 7 | 1.00 (±0.01) | 20.6 (±0.3) | 21.1 (±0.3) | 43 (±0.5) | 76 (±3) | 44.6 (±0.2) | 67.5 (±0.1) | 43 (±1) | 81 (±1) |
| 8 | 0.79 (±0.05) | 20.7 (±0.2) | 21.3 (±0.2) | 28.7 (±0.6) | 55 (±1) | 22.6 (±0.1) | 49.2 (±0.1) | 51 (±1) | 83 (±2) |
| 9 | 1.12 (±0.05) | 19.8 (±0.2) | 20.4 (±0.2) | 29.4 (±0.5) | 57 (±2) | 23.0 (±0.1) | 52.1 (±0.4) | 48 (±1) | 84 (±2) |
| 10 | 0.84 (±0.02) | 20.2 (±0.1) | 20.8 (±0.1) | 28.5 (±1.1) | 51 (±1) | 25.3 (±0.9) | 50.8 (±0.1) | 48 (±2) | 86 (±3) |
| 11 | 0.84 (±0.02) | 20.0 (±0.1) | 20.6 (±0.1) | 38.4 (±0.5) | 63 (±1) | 33.4 (±0.7) | 56.2 (±0.1) | 46 (±1) | 83 (±6) |
| 12 | 0.73 (±0.03) | 19.8 (±0.1) | 20.3 (±0.1) | 42.2 (±0.5) | 72 (±1) | 39.8 (±0.9) | 63.8 (±0.1) | 44 (±1) | 84 (±1) |
| 13 | 0.35 (±0.01) | 19.8 (±0.1) | 20.4 (±0.1) | 48.1 (±1.1) | 81 (±2) | 44.9 (±0.1) | 68.2 (±0.5) | 32 (±3) | 51 (±7) |
| 14 | 0.42 (±0.02) | 19.8 (±0.1) | 20.3 (±0.1) | 39.2 (±0.7) | 78 (±2) | 37.6 (±0.1) | 53.9 (±0.1) | 34 (±3) | 68 (±2) |

and Control Sample 14. Each of the three samples had a $B_s$ between HIPERCO® 27 and Control Sample 14, and greater than desired $B_s$ of 20 kG. Each of the three samples also had a $H_c$ between HIPERCO® 27 and Control Sample 14, and met the desired $H_c$ of less than 2.0 Oe. However, only sample 7 (Co=7.99 wt. %, Mn=2.22 wt. %, and Si=1.25 wt. %) had the desired ρ of greater than 40 μΩcm. As can be seen by comparing these alloys to the first series of alloys, an decrease in Mn content (composition of other elements remaining constant) decreases ρ and $H_c$, but has only a marginal effect on $B_s$.

FIG. 1C depicts the five samples (Samples 9-13) having approximately 5 wt. % Co as compared to HIPERCO® 27 and Control Sample 14. Each of the three samples had a $B_s$ between HIPERCO® 27 and Control Sample 14, and greater than desired $B_s$ of 20 kG. Each of the three samples also had a $H_c$ between HIPERCO® 27 and Control Sample 14, and met the desired $H_c$ of less than 2.0 Oe. However, only sample 12 (Co=4.97 wt. %, Mn=2.21 wt. %, and Si=1.32 wt. %) and sample 13 (Co=4.99 wt. %, Mn=1.03 wt. %, and Si=2.31 wt. %) had the desired ρ of greater than 40 μΩcm.

A regression analysis was performed to determine the relationship between the concentrations of Co, Mn, and Si in the samples and their effects on $B_s$, $H_c$, and ρ. Those relations are expressed by the following equations, where $X_{Co}$ is the Co concentration, $X_{Mn}$ is the Mn concentration, and $X_{Si}$ is the Si concentration:

$$B_s=20.7+0.153*X_{Co}-0.322*X_{Mn}-0.318*X_{Si} \quad (R^2=0.86;p=0.00) \qquad \text{(Formula 1);}$$

$$H_c=-0.209+0.062*X_{Co}+0.317*X_{Mn}-0.096*X_{Si} \quad (R^2=0.86;p=0.00) \qquad \text{(Formula 2); and}$$

$$\rho=13.4+0.557*X_{Co}+0.451*X_{Mn}+12.2*X_{Mn} \quad (R^2=0.86;p=0.00) \qquad \text{(Formula 3).}$$

From these equations, it can be determined that, for the range of alloys examined, an increase in Co concentration has a positive effect on $B_s$, while increases in Mn concentration and Si concentration have negative effects, and the negative effects of Mn and Si concentration on $B_s$ are approximately equal and are approximately double the positive effect of Si concentration. It can also be determined that increasing Co concentration increases $H_c$, increasing Mn concentration increases $H_c$, and increasing Si concentration decreases $H_c$. The effects of increasing Co and Si concentrations on $H_c$ are small relative to the effect of increasing Mn concentration. It can also be determined that increasing any of Co, Mn, or Si concentration increases ρ, but that the effect of Si concentration is approximately 2.7 times greater than the effect of Mn concentration and approximately 22 times greater than the effect of Co concentration.

Figure 2A:
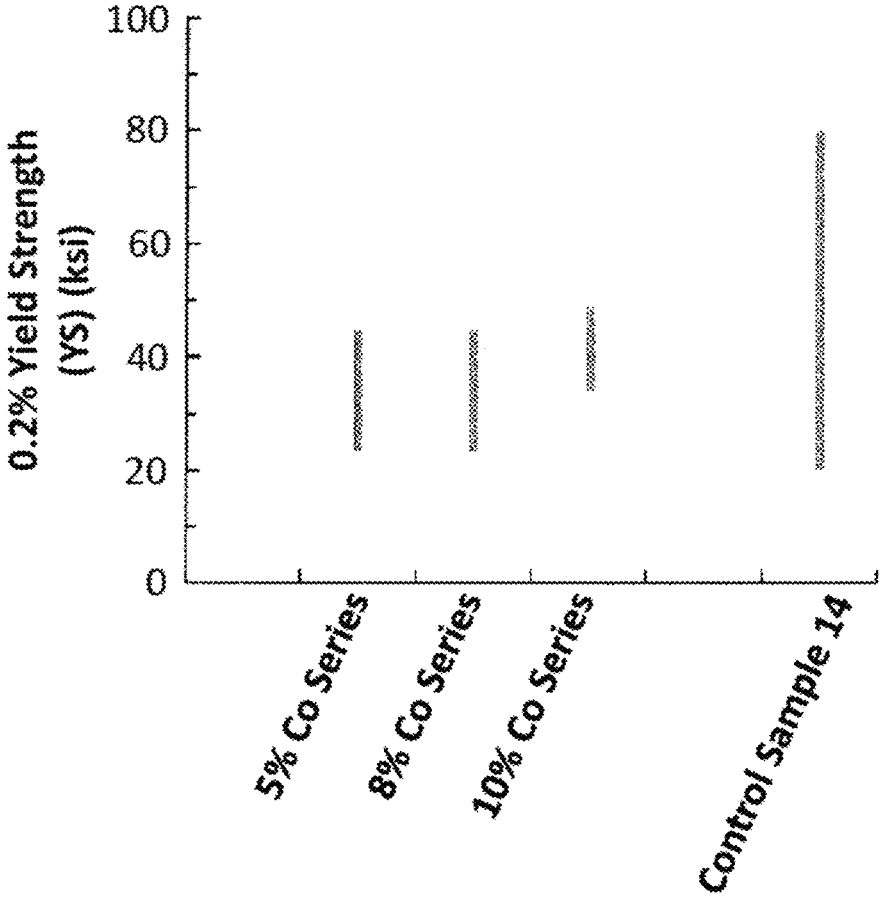
FIG. 2A is a graph depicting 0.2% yield strengths for three series of alloys having approximately 10 wt. % Co, approximately 8 wt. % Co, and approximately 5 wt. % Co as compared to a substantially Co-free control sample, according to embodiments of the invention.
Figure 2B:
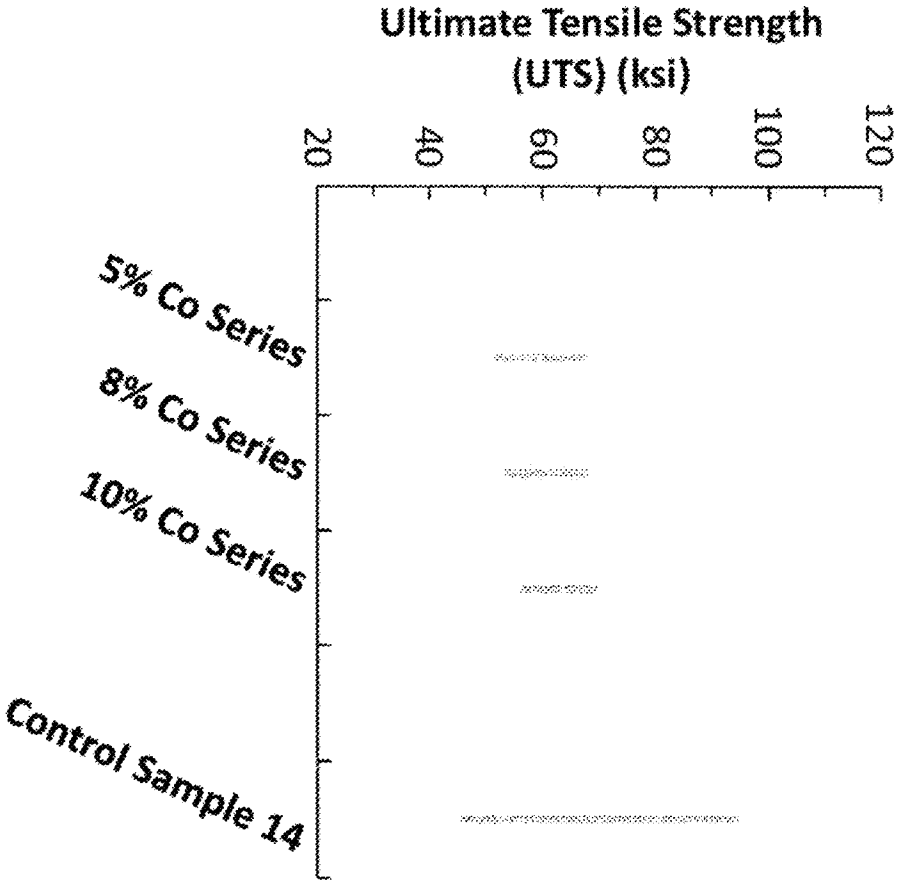
FIG. 2B is a graph depicting ultimate tensile strengths for three series of alloys having approximately 10 wt. % Co, approximately 8 wt. % Co, and approximately 5 wt. % Co as compared to a substantially Co-free control sample, according to embodiments of the invention.
Figure 2C:
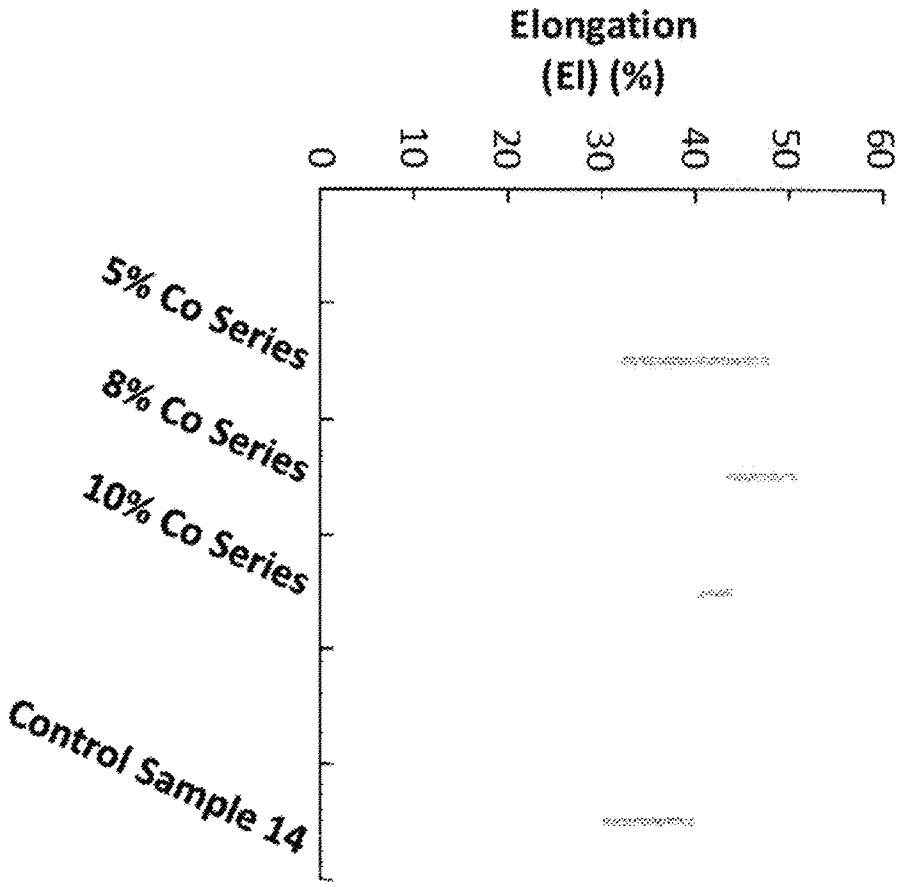
FIG. 2C is a graph depicting elongation for three series of alloys having approximately 10 wt. % Co, approximately 8 wt. % Co, and approximately 5 wt. % Co as compared to a substantially Co-free control sample, according to embodiments of the invention.

FIGS. 2A-2C depict various mechanical properties of each series of alloys (i.e., approximately 10 wt. % Co, approximately 8 wt. % Co, and approximately 5 wt. % Co) as compared to Control Sample 14 (i.e., the a substantially Co-free control sample), including yield strength (FIG. 2A), tensile strength (FIG. 2B), and elongation (FIG. 2C). For each series, the mechanical properties are suitable for soft-magnetics applications. In general, within a series, an increase in Si concentration leads to an increase in strength, as measured by yield strength and tensile strength, and a marginal decrease in ductility, as measured by elongation, while an increase in Mn leads to a marginal increase in strength and a decrease in ductility.

Figure 3A:
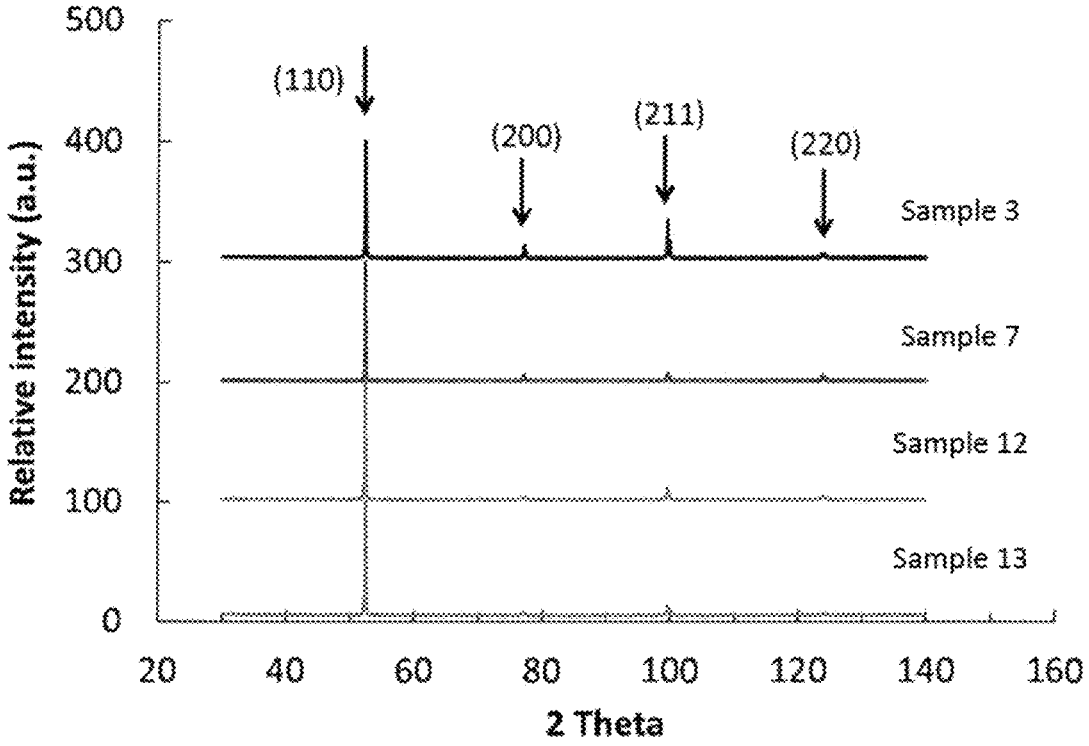
FIG. 3A is a graph depicting x-ray diffraction spectra of four alloys according to embodiments of the invention.
Figure 3B:
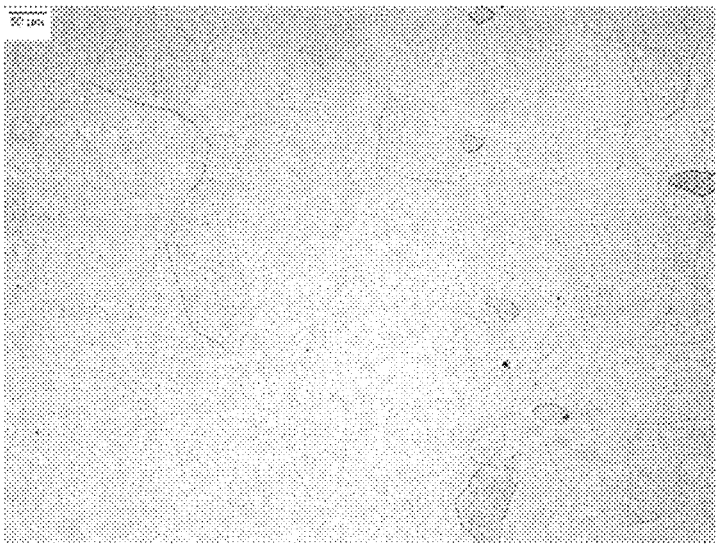
FIG. 3B is an optical micrograph of a first alloy according to an embodiment of the invention.
Figure 3C:
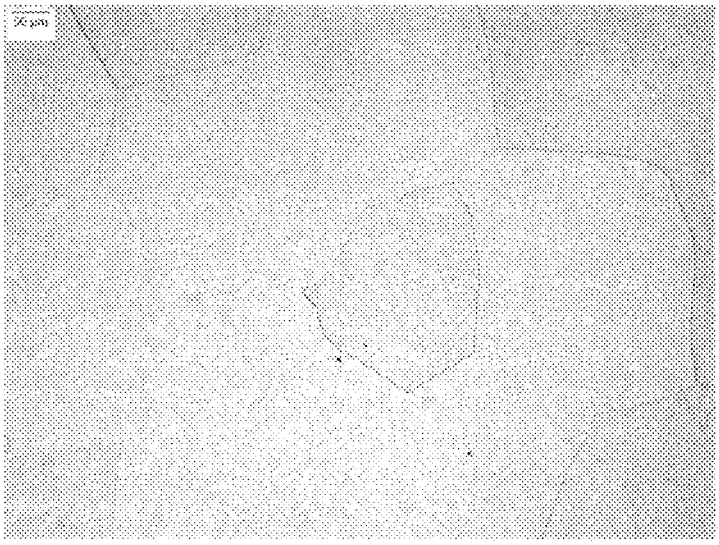
FIG. 3C is an optical micrograph of another alloy according to an embodiment of the invention.

FIG. 3A depicts x-ray diffraction data for four exemplary alloys, specifically Samples 3, 7, 12, and 13. The x-ray diffraction data for each alloy indicate that they are single phase alloys and the (110), (200), (211), and (220) diffraction peaks correspond to a ferrite or α phase (BCC). Optical micrographs of Samples [12] (FIG. 3B) and [13] (FIG. 3C) confirm the presence of a single phase.

In the second processing route, a portion of each 2 inch (5 cm) square bar was heated to 2,200° F. (1,204° C.) and hot-rolled to a strip with a thickness of 0.25 inch (0.64 cm). The strip was then sandblasted to remove scale and cold rolled to a thickness of 0.080 inch (0.2 cm), annealed at 1,300° F. (704° C.) for 2 hours in dry $H_2$, and cold rolled again to a thickness of approximately 0.045 inch (0.11 cm). Rings were then stamped from the strip and annealed in dry hydrogen ($H_2$) at 2,156° F. (1,180° C.), cooled at a rate of 200° F. (930° C.) per hour to 1,290° F. (699° C.), and held at 1,290° F. (699° C.) for 24 hours. Each ring was then characterized for coercivity ($H_c$), magnetic induction at 200 Oe ($B_{200}$), and core loss ($P_c$) (measured at 60 Hz and 15 kG). The results are reported below in Table 3.

TABLE 3

| Sample | $H_c$ (Oe) | $B_{200}$ (kG) | $P_c$ (W/lb) |
|---|---|---|---|
| 1 | 1.25 (±0.01) | 20.5 (±0.4) | 4.02 (±0.01) |
| 2 | 1.22 (±0.01) | 19.6 (±0.7) | 4.36 (±0.01) |
| 3 | 1.16 (±0.01) | 19.7 (±0.1) | 3.99 (±0.01) |
| 4 | 1.15 (±0.01) | 20.8 (±0.2) | 4.22 (±0.01) |
| 5 | 0.91 (±0.01) | 19.1 (±0.1) | 4.94 (±0.02) |
| 6 | 0.98 (±0.01) | 20.7 (±0.1) | 4.81 (±0.01) |
| 7 | 0.80 (±0.01) | 20.7 (±0.1) | 4.62 (±0.01) |
| 8 | 0.79 (±0.01) | 20.6 (±0.1) | 5.30 (±0.01) |
| 9 | 0.99 (±0.01) | 19.8 (±0.1) | 6.03 (±0.01) |
| 10 | 0.74 (±0.01) | 20.6 (±0.1) | 4.37 (±0.01) |
| 11 | 0.74 (±0.01) | 19.9 (±0.1) | 4.31 (±0.01) |
| 12 | 0.60 (±0.01) | 20.2 (±0.1) | 4.18 (±0.01) |
| 13 | 0.26 (±0.01) | 19.8 (±0.3) | 4.55 (±0.01) |
| 14 | 0.39 (±0.01) | 19.9 (±1.0) | 3.75 (±0.01) |

Figure 4:
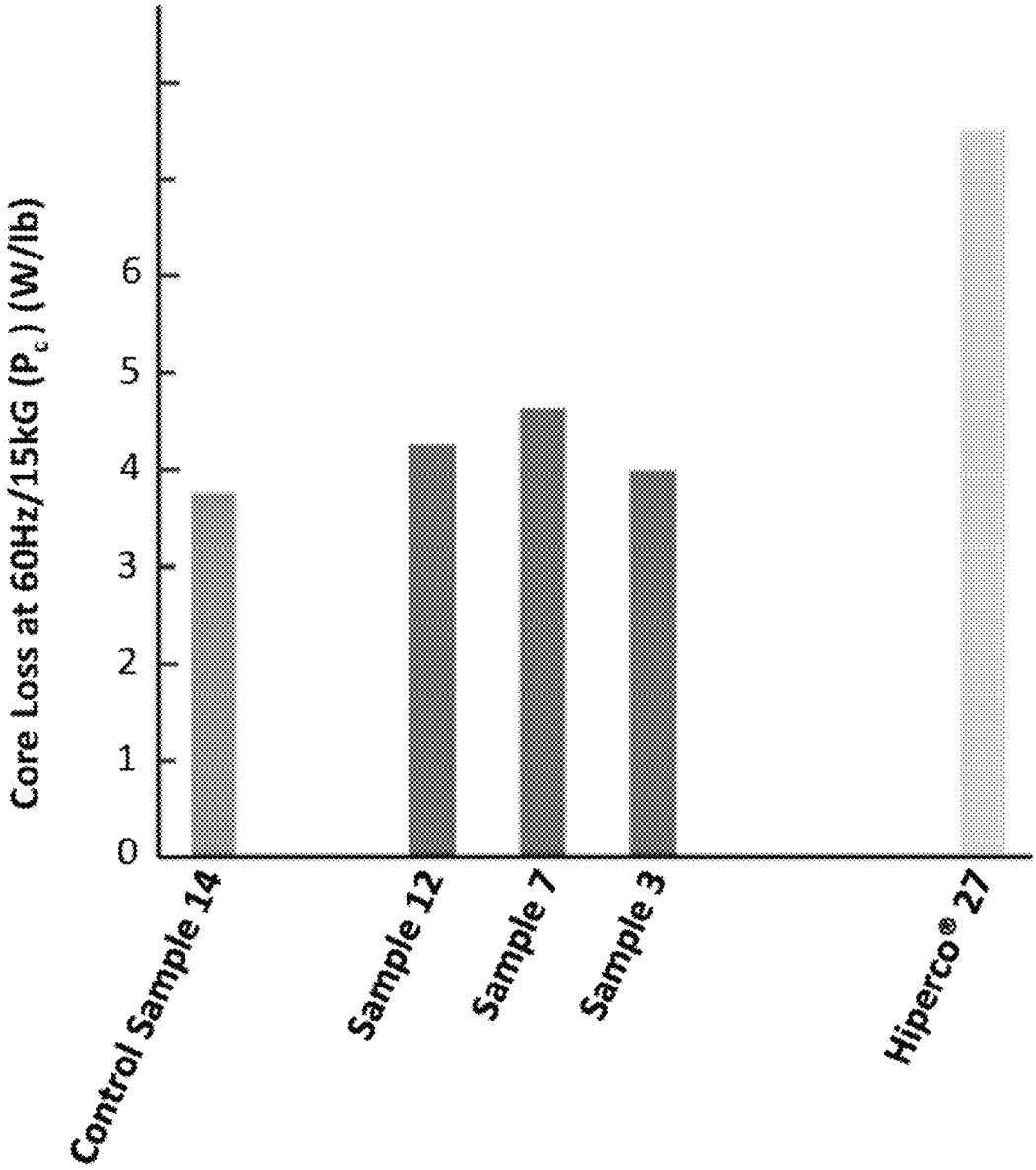
FIG. 4 is a graph depicting core loss for three alloys as compared to HIPERCO® 27 and a substantially Co-free control sample, according to an embodiment of the invention.

FIG. 4 depicts the $P_c$ of three samples (Samples 3, 7, and 12) which meet the desired properties ($B_s$ greater than 20 kG, ρ greater than 40 μΩcm, and $H_c$ of less than 2 Oe) prior to being processed into strips as compared to strips of HIPERCO® 27 and Control Sample 14. As can be seen from FIG. 4, Samples 3, 7, 12 each have a $P_c$ value similar to the cobalt-free Control Sample 14, but less than the $P_c$ value of HIPERCO® 27.

Although illustrated and described above with reference to certain specific embodiments and examples, the present invention is nevertheless not intended to be limited to the details shown. Rather, various modifications may be made in the details within the scope and range of equivalents of the claims and without departing from the spirit of the invention. It is expressly intended, for example, that all ranges broadly recited in this document include within their scope all narrower ranges which fall within the broader ranges. It is also expressly intended that the steps of the methods of using the various devices disclosed above are not restricted to any particular order.

What is claimed:

1. A magnetic isotropic iron alloy comprising:

Iron (Fe);

cobalt (Co) from greater than 5 wt % to approximately 8 wt. %;

approximately 0.05 wt. % to approximately 5 wt. % manganese (Mn);

approximately 1.3 wt. % to approximately 5 wt. % silicon (Si);

chromium, up to approximately 0.3 wt. %;
vanadium, up to approximately 2 wt. %;
copper, up to approximately 0.05 wt. %; and
gadolinium (Gd) from 0.11 wt % to approximately 0.15 wt %.

2. The magnetic iron alloy of claim 1, further comprising one or more of:
nickel up to approximately 1 wt. %;
niobium up to approximately 0.05 wt. %; and
carbon up to approximately 0.02 wt. %.

3. The magnetic iron alloy of claim 1, wherein the alloy has an electrical resistivity (ρ) of at least approximately 40 μΩcm.

4. The magnetic iron alloy of claim 1, wherein the alloy has a saturation induction ($B_s$) of at least approximately 20 kG.

5. The magnetic iron alloy of claim 1, wherein the alloy has a coercivity ($H_c$) of less than approximately 2 Oe.

6. The magnetic iron alloy of claim 1, wherein the alloy has an ρ of at least approximately 40 μΩcm, a $B_s$ of at least approximately 20 kG, and a $H_c$ of less than approximately 2 Oe.

7. The magnetic iron alloy of claim 1, wherein the alloy comprises primarily a single alpha (α) phase.

8. The magnetic iron alloy of claim 7, wherein the alloy comprises at least approximately 95% of the alpha phase.

9. The magnetic iron alloy of claim 7, wherein the alloy comprises at least approximately 99% of the alpha phase.

10. A magnetic iron alloy comprising:
iron;
cobalt from greater than 5 wt. % to approximately 8 wt. %;
approximately 0.05 wt. % to approximately 5 wt. % manganese;
approximately 1.3 wt. % to approximately 5 wt. % silicon,
chromium, up to approximately 0.3 wt. %;
vanadium, up to approximately 2 wt. %;
copper, up to approximately 0.05 wt. %; and
gadolinium (Gd) from 0.11 wt % to approximately 0.15 wt %,
wherein the alloy has a ρ of at least approximately 40 μΩcm, a $B_s$ of at least approximately 20 kG, and a $H_c$ of less than approximately 2 Oe.

11. The magnetic iron alloy of claim 10, further comprising one or more of:
nickel up to approximately 1 wt. %;
niobium up to approximately 0.05 wt. %; and
carbon up to approximately 0.02 wt. %.

12. The magnetic iron alloy of claim 10, wherein the alloy comprises at least approximately 95% of an alpha phase.

13. The magnetic iron alloy of claim 10, wherein the alloy comprises at least approximately 99% of an alpha phase.

14. The magnetic iron alloy of claim 10, wherein the alloy includes approximately 8 wt. % Co, approximately 2.2 wt. % Mn, and approximately 1.3 wt. % Si.

* * * * *